US008430566B2

(12) United States Patent
Brauer et al.

(10) Patent No.: US 8,430,566 B2
(45) Date of Patent: Apr. 30, 2013

(54) SIDE-GUSSETED BAG AND METHOD FOR MANUFACTURING SAME

(75) Inventors: Jochen Brauer, Lohne (DE); Mark W. Gum, East Prairie, MO (US)

(73) Assignee: Mondi Jackson, Inc., Jackson, MO (US)

( * ) Notice: Subject to any disclaimer, the term of this patent is extended or adjusted under 35 U.S.C. 154(b) by 172 days.

(21) Appl. No.: 12/799,819

(22) Filed: May 3, 2010

(65) Prior Publication Data

US 2011/0268372 A1 Nov. 3, 2011

(51) Int. Cl.

| | |
|---|---|
| ***B65D 33/16*** | (2006.01) |
| ***B65D 33/10*** | (2006.01) |
| ***B65D 33/00*** | (2006.01) |
| ***B65D 30/08*** | (2006.01) |
| ***B65D 30/20*** | (2006.01) |
| ***B31B 1/90*** | (2006.01) |
| ***B31B 1/26*** | (2006.01) |

(52) U.S. Cl.
USPC ..... 383/66; 383/7; 383/204; 383/61.2; 383/63; 383/64; 383/109; 383/120; 383/906; 493/214; 493/231; 493/244

(58) Field of Classification Search ..... 383/66, 383/120, 61.2, 203, 204, 63, 64, 10, 16, 25, 383/109, 906, 7; 493/214, 243, 231, 244
See application file for complete search history.

(56) References Cited

U.S. PATENT DOCUMENTS

| | | | | |
|---|---|---|---|---|
| 6,254,273 | B1 * | 7/2001 | Galomb et al. | 383/63 |
| 6,481,183 | B1 | 11/2002 | Schmidt | |
| 6,971,794 | B2 * | 12/2005 | Yeager | 383/61.2 |
| 2006/0291755 | A1 * | 12/2006 | Olin et al. | 383/66 |
| 2008/0013866 | A1 | 1/2008 | Kujat et al. | |
| 2010/0142858 | A1 * | 6/2010 | Kruse et al. | 383/5 |

FOREIGN PATENT DOCUMENTS

| | | | |
|---|---|---|---|
| GB | 2288566 | A * | 10/1995 |
| JP | 08026302 | A * | 1/1996 |
| JP | 2001031119 | A * | 2/2001 |
| WO | WO 2004110875 | A2 * | 12/2004 |
| WO | WO 2008/145164 | | 12/2008 |

* cited by examiner

*Primary Examiner* — Jes F Pascua
(74) *Attorney, Agent, or Firm* — Collard & Roe, P.C.

(57) ABSTRACT

A side-gusseted bag has two front walls which are joined by a side gusset at a longitudinal side provided with a reclosure. The side gusset is folded-over outwards in the region of the reclosure in such a manner that the side gusset ends at its folded-over section at the associated longitudinal side. The reclosure running in the longitudinal direction is fastened to an inner surface of the side gusset at the folded-over section. A method for manufacturing a side-gusseted bag is also provided.

25 Claims, 8 Drawing Sheets

SIDE-GUSSETED BAG AND METHOD FOR MANUFACTURING SAME

BACKGROUND OF THE INVENTION

1. Field of the Invention

The invention relates to a side-gusseted bag having two front walls which are joined by means of a side gusset on a longitudinal side provided with a reclosure. The subject matter of the invention is also a method for producing such a side-gusseted bag. The present invention relates in particular to pre-made bags which are manufactured individually in the laid-flat state, transported and only filled in a subsequent step.

2. The Prior Art

Known from WO 2008/145164 A1 is a side-gusseted bag having front walls which are joined by side gussets running in the longitudinal direction. Provided in the top region of the bag is a reclosure running in the transverse direction which is sealed both onto the associated side gusset and the front walls on the inner side of the gusset. On opening the reclosure, the side gusset is folded out at its upper end to form a large pouring spout. The known side-gusseted bag is therefore suitable for withdrawing large quantities at once. In addition, a carrying handle is provided on the opposite side gusset which facilitates handling. Nevertheless, the withdrawal of small portions can prove difficult on account of the large withdrawal opening. The known configuration is also not suitable for reclosures which can be opened and closed by means of a slider. The folding-in and folding-out of the side gusset requires a certain dexterity of the user.

Known from U.S. Pat. No. 6,481,183 B1 is a side-gusseted bag which has a reclosure with a slider in the region of one of its side gussets. The reclosure is located above one of the side gussets in a special corner section. The precise type of arrangement and the execution of the corner section are not described. In addition, U.S. Pat. No. 6,481,183 B1 relates to a method for manufacturing FFS bags (form, fill and seal bags), where the bag is only formed immediately before filling. The bag is initially produced in practice as a tube around the filling funnel of the filling material, in which case only comparatively simple means can be used for forming the bag.

SUMMARY OF THE INVENTION

Against this background, it is the object of the invention to provide a side-gusseted bag having a reclosure which allows the precise withdrawal of small partial quantities and which can be manufactured and handled easily and reliably. In particular, the side-gusseted bag as a pre-made bag should also be suitable for subsequent filling.

The subject matter of the invention and the solution of the object is a side-gusseted bag having two front walls which are joined by means of a side gusset at a longitudinal side provided with a reclosure, wherein an end section of the side gusset is folded-over in the region of the reclosure in such a manner that a central line running approximately in the longitudinal direction in the non-folded-over region of the side gusset is bent outwards at an angle and wherein the reclosure running in the longitudinal direction is fastened to an inner surface of the side gusset at the folded-over end section. In order to expose the withdrawal opening, only the usually two straight-running strips of the reclosure need to be separated. Folding out the side gusset is not necessary and also not possible since the side gusset is fixed at its folded-over section by the reclosure fastened there.

The side-gusseted bag according to the invention is characterised by very easy handling, wherein particularly small quantities can be metered exactly. Due to the side gusset which is folded outwardly and ends on the longitudinal side, a funnel effect is also achieved inside the bag which facilitates a complete emptying of the side-gusseted bag. If, according to a preferred embodiment of the invention, the side-gusseted bag is initially provided as a laid-flat bag for subsequent filling, this also has the advantage that the transverse side provided as the upper bag edge which is usually not yet closed, is completely accessible so that, for example, a filling funnel can easily be inserted.

The side-gusseted bag is folded over at two fold lines running obliquely outwards. The oblique fold lines begin at the center of the side gusset disposed between the front walls in relation to a flat-lying side-gusseted bag and then run obliquely outwards at an angle of typically between 20° and 50°. Accordingly, a central line of the side gusset running in the longitudinal direction in the non-folded-over end section of the side gusset typically bends at an angle between 95° and 40° at the transition to the folded-over section.

According to a preferred embodiment, the side gusset provided with the reclosure running in the longitudinal direction ends with its folded-over end section at a distance from an associated transverse side which usually forms the upper bag edge. The reclosure can then be fastened with a first part on the inner surface of the side gusset and with a second part on an inner surface of the two front walls. Particularly easy handling is achieved if the reclosure extends as far as the associated transverse side.

The reclosure usually comprises two profile strips which can be locked with one another, each of which is adjoined by a connecting flange by which means the reclosure is fastened, preferably by heat sealing. The locking is usually effected in the manner of a tongue and groove join, wherein profiles which are lockable with themselves and also a combination of male profiles having at least one projection and associated female profiles having at least one receptacle for the projection can be provided. Depending on the design of the reclosure, provision can be made to join the profiles to one another by manual pressure. Corresponding reclosures are also designated in practice as zippers. Preferred, however, is an embodiment in which a slider overlaps the two profiles, wherein the profiles are joined by a movement of the slider in a first direction and are separated by a movement in the opposite direction. Such reclosures are designated in practice as slider closures. The reclosure must project laterally at least with its profiles so that the slider can be actuated.

At the same time, the front walls can be set back, for example by corresponding lateral stampings, in such a manner that the reclosure projecting from the front walls at the associated longitudinal side is approximately flush with the non-set-back part of the front walls. During the handling of laid-flat, ready-prepared side-gusseted bags, the non-projecting or non-significantly projecting reclosure is protected from damage.

According to an alternative embodiment of the invention, it is provided that the reclosure ends set back at a distance from the associated longitudinal side and is covered by wall sections of the front walls. For this purpose, an outer edge of the side gusset can be remote at the end section, wherein then as a result of the lateral shortening of the side gusset, the two front walls extend over this. According to a particularly advantageous further development, the wall sections covering the reclosure on the associated longitudinal side can be interconnected, for example, by a heat-sealing seam. Before a first opening of the side-gusseted bag, the reclosure is then arranged so that it is protected in a type of pocket and initially also not visible, thus ensuring overall a high-quality appearance of the side-gusseted bag. The covered arrangement of the reclosure in the pocket is particularly advantageous when as described previously, a slider is provided for actuating the reclosure. The covered arrangement can avoid any unintentional movement and also any damage to the slider projecting over the profile of the reclosure.

In order to expose the reclosure at the respective longitudinal side of the side-gusseted bag within the scope of the described embodiment, the described pocket should be torn open or torn off. In particular, a line of weakening, for example, in the form of a perforation, can be provided for this purpose, along which the wall sections covering the reclosure and connected to one another can be separated from the bag body.

As described before, the reclosure is preferably provided with two profile strips which can be locked with one another. Nevertheless other embodiments of the reclosure may be used within the scope of the present invention. The reclosure can, for example, also be provided as a spout which might comprise a screw cap. Such an embodiment is advantageous for liquid or paste-like ingredients products.

The side-gusseted bag usually has a second side gusset opposite the longitudinal side provided with the reclosure. However, such a configuration is not essential within the context of the invention. In order to allow easy manufacture and handling, the second side gusset can be shortened at its upper end, i.e. set back with respect to the upper bag edge.

Usually a first transverse side forms a base and a second transverse side forms a top of the bag, wherein the base and the top are joined by the front walls and the at least one interposed side gusset and wherein the reclosure is preferably disposed directly below the top.

In order to facilitate the handling with such a bag, a carrying handle can be provided at the top of the bag, on a side gusset or also on one of the front walls. In an embodiment having a first side gusset and a second side gusset, it is particularly preferable if the carrying handle is disposed on the side gusset opposite the reclosure since this allows particularly easy handling and easy pouring of the accommodated packaged goods. Suitable embodiments of carrying handles in a side gusset are known from WO 2008/145164 A1. A suitable configuration of carrying handles at the top of the bag is known from US 2008/0013866 A1. However, since according to the present invention the reclosure is arranged on one longitudinal side, simple carrying handles can also be provided which are guided into the interior of the bag at the upper edge of the bag and are fastened to the heat-sealable inner surface.

The side-gusseted bag is preferably formed by heat sealing either from a single film section or individual film sheets for the front walls and the side gussets. Regardless of whether the side-gusseted bag is formed from one film section or several film sheets, the bag film is usually configured to be multilayer, wherein a layer forming the inner side of the front walls and the at least one side gusset is readily heat-sealable. Polyolefins such as polyethylene (PE), polypropylene (PP) as well as polymer mixtures based on PE and/or PP are particularly suitable.

In order to avoid the appearance of the side-gusseted bag being adversely affected during a heat sealing, a layer having a higher softening temperature than the polymer layer on the inner side is expediently provided for the outer side of the front walls and the at least one side gusset. Polyethylene terephthalate (PET) is particularly suitable as material for the outer side as a result of its mechanical properties and the high-quality appearance.

According to the present invention, the side gusset on which the reclosure is fastened is guided in the direction of the lateral edge by folding over. Apart from an optionally provided shortening and/or edge-side trimming of the side gusset, no additional incisions or openings are required in this case so that the reclosure can be arranged simply in an airtight manner. In particular, if a film is used to form the side gusset or the entire side-gusseted bag, which film is not heat-sealable or barely heat-sealable on its outer side, the embodiment according to the invention affords the advantage that the preferred good heat-sealable inner surface of the side gusset is available for a tight connection to the reclosure due to the folding over.

The bag film can be formed by laminating and also by co-extrusion. A laminating film has the advantage that the outer layer can be printed on the inside, thus reliably avoiding abrasion of the imprint. In the case of laminating, it is furthermore possible to provide metal layers or metallised polymer layers in the laminating composite.

The subject matter of the invention is also a method for producing the previously described side-gusseted bag. The method according to the invention comprises producing two front walls and at least one interposed side gusset, folding one end of the side gusset along two oblique fold lines emanating from a central line running in the longitudinal direction of the side gusset, arranging a reclosure on the folded-over section of the side gusset and fastening the reclosure on an inner surface of the side gusset.

Folding over one end of the side gusset can take place either before or after forming a bag blank consisting of two front walls and at least one interposed side gusset. Thus it is within the scope of the invention to initially fold over the side gusset and then at least prefix between the front walls. Alternatively it is also possible to initially form a bag blank and only then fold over the side gusset so that this ends on the longitudinal side or is guided out. In this case, however, it must be ensured that the end of the side gusset to be folded over in the bag blank is still accessible. If the entire side-gusseted bag is formed from a single film section, the side gusset to be folded over should then first be separated from the adjoining front walls.

The method according to the invention usually comprises cutting the side gusset to size before or after the folding over.

According to a preferred embodiment, a bag blank is formed from the front walls and two interposed side gussets in which the side gussets are not joined to the front walls in a top region. If the front walls and the side gussets are formed jointly by folding from a bag film, it is necessary to cut through the bag film at the top region by making an incision, stamping or the like. In particular, longitudinal sealing seams which leave out the top region can be produced, in which case the bag film is separated subsequently by trimming the longitudinal edges. The front walls are folded back onto themselves in the top region in such a manner that the end sections of the side gussets are exposed. Subsequently, the reclosure can be fastened on the folded-over end of one of the side gussets, a pre-fixing being sufficient initially. It lies within the context of the invention to produce a permanent, continuous join only when the regions of the front walls which have been folded onto themselves have been folded back again after arranging the reclosure and joined to the side gussets.

In the case of a filled, closed side-gusseted bag, it is advantageous if, prior to a first opening, the reclosure is protected from any damage and from any unintentional actuation. Furthermore, it is advantageous if a user immediately identifies that the side-gusseted bag has not been tampered with and still has the original seal. In order to protect the reclosure from mechanical influences, this can be arranged in an inwardly offset manner with respect to the adjoining longitudinal side underneath. Thus, according to a first further development it is provided that lateral wall sections of the front walls are removed in the region of the reclosure, wherein the reclosure can then be arranged accordingly in an inwardly offset manner starting from the adjoining longitudinal side underneath. A certain protection of the reclosure can be achieved by the set-back arrangement but this remains freely accessible.

According to an alternative further development, it is provided to shorten the side gusset on which the reclosure is arranged and trim at its outer edge before folding over so that after folding over, the folded-over region as well as the reclosure fastened thereon are arranged offset with respect to the center of the bag. The front walls are not stamped out so that the inwardly offset reclosure is covered by wall sections of the front walls. These protruding wall sections improve the protection of the reclosure. Optionally, for further improvement of the protection, a joining of the wall sections, in particular by a longitudinal sealing seam, can be made, forming a pocket closed on the edge side in which the reclosure is arranged in a protected manner. In order to reach the reclosure when opening for the first time, the interconnected wall sections can either be separated from one another or preferably torn away. For this purpose, the front walls can have weakening lines, in particular perforations. These weakening lines are expediently produced before arranging the reclosure.

In accordance with the previously described possible embodiments of the side-gusseted bag, the method can be executed in such a manner that the reclosure is joined to the inner surface of the side gussets and above the side gussets to the inner surfaces of the front walls.

In order to achieve an authenticity seal, in addition to the profiles which can be joined to one another, it is also possible to fit the parts of the reclosure with a tearable connection.

As has already been explained, the reclosure preferably has two interlockable profiles as well as a slider which overlaps the profiles. An end stop for the slider can either be prepared thermoplastically from the material of the profiles or by an additional element in the form of a clip. The strip-like profiles of the described slider closure, which are usually formed thermoplastically, exhibit a certain stiffness. In order to be able to form a sufficiently large removal opening, against this background it can be provided to weaken the profiles with the adjoining connecting flanges transversely to the course of the interlockable profiles, for which purpose for example a perforation can be provided over half the length of the reclosure.

As described previously, the central line bends at an angle between 95° and 40° at the transition to the folded-over section. Accordingly, the central line can therefore run at a slight slope at the folded-over end section, in particular at a slight slope in the direction of the upper side of the bag. The lower edge of the reclosure should preferably be trimmed at a corresponding slope. If, for example, the central line rises typically at an angle of 10° to 15°, a corresponding angle should also be provided at the associated end of the reclosure. The fastening of the reclosure can be effected by sealing, in particular ultrasound welding or heat sealing.

BRIEF DESCRIPTION OF THE DRAWINGS

The invention is explained hereinafter with reference to a drawing showing merely one exemplary embodiment. In the figures.

DETAILED DESCRIPTION OF PREFERRED EMBODIMENTS

Figure 1:
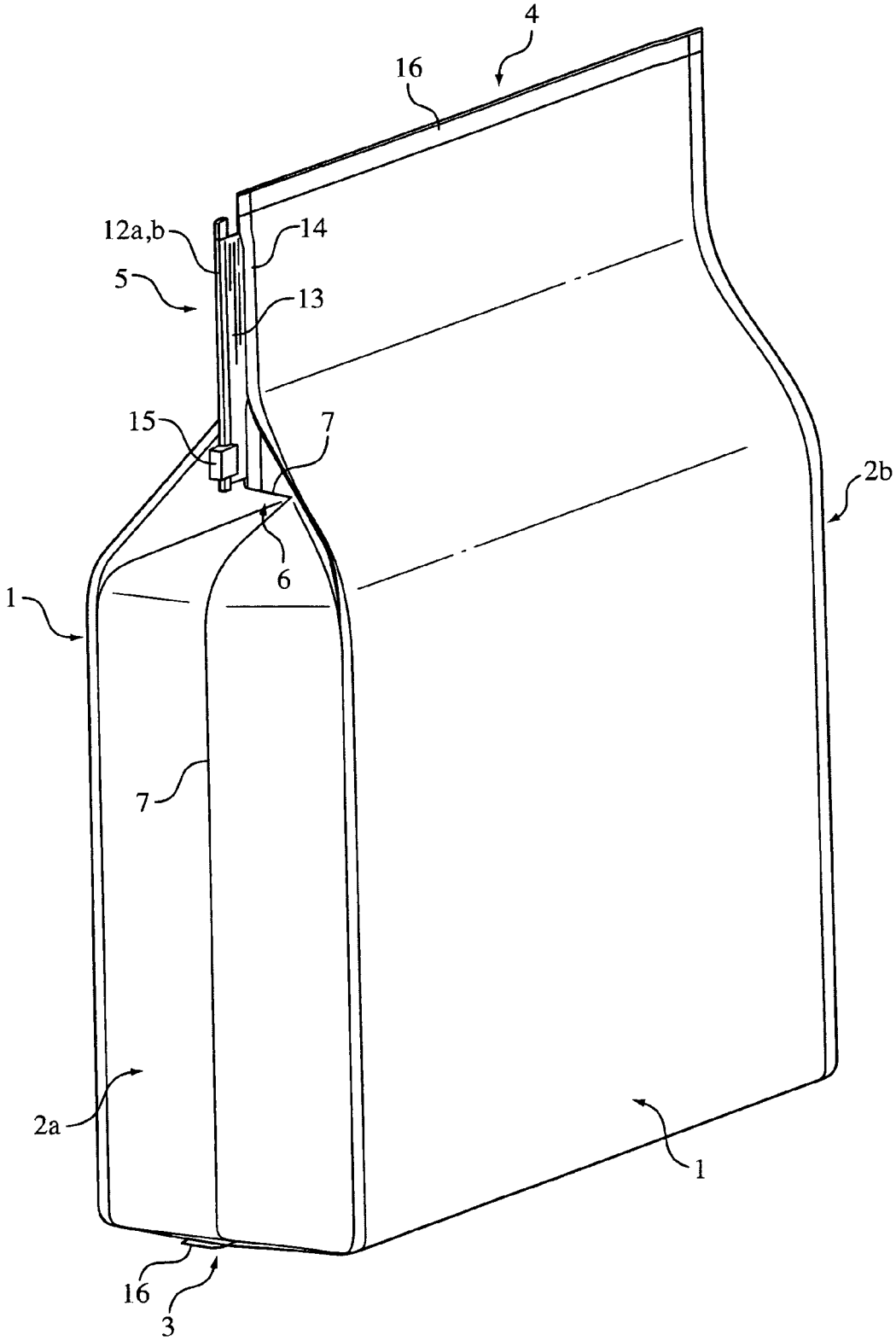
FIG. 1 shows a perspective view of a side-gusseted bag having a reclosure on the longitudinal side.
Figure 2:
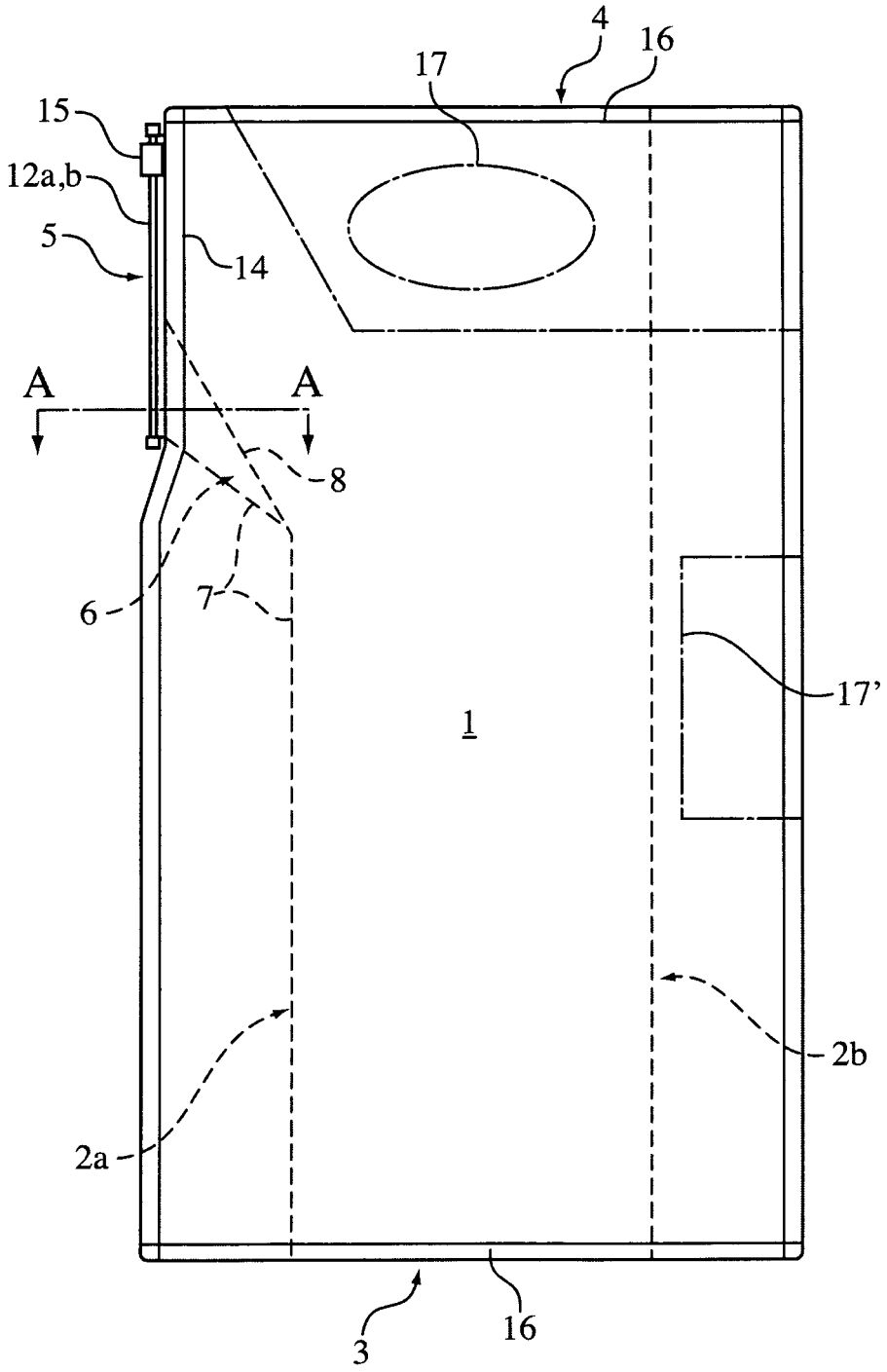
FIG. 2 shows a side-gusseted bag according to FIG. 1 in a schematic plan view.

FIGS. 1 and 2 shows a side-gusseted bag having two front walls 1 and two side gussets 2*a*, 2*b* which join the front walls 1 between a base 3 and a top 4 of the bag at the longitudinal sides of the bag. A reclosure 5 running in the longitudinal direction is located below the top 4 on one of the side gussets 2*a*. It can be seen from a comparative analysis of FIG. 1 with FIG. 2 which shows the side-gusseted bag in the laid-flat state, that the upper end of the side gusset 2*a* provided with the reclosure 5 is folded over outwards, i.e. towards the lateral bag edge. The side gusset 2*a* ends with its folded-over section 6 in the region of the associated longitudinal side.

According to FIG. 2, a central line 7 usually configured as a folding edge runs in the lower region of the side gusset 2*a* substantially in the longitudinal direction. At the transition into the folded-over section 6 this central line 7 of the side gusset 2*a* is bent over between 40° and 95°. Accordingly, two obliquely outwardly running fold lines 8 are formed which are bent with respect to the longitudinal direction by approximately half the angle compared to the central line 7.

Figure 3:
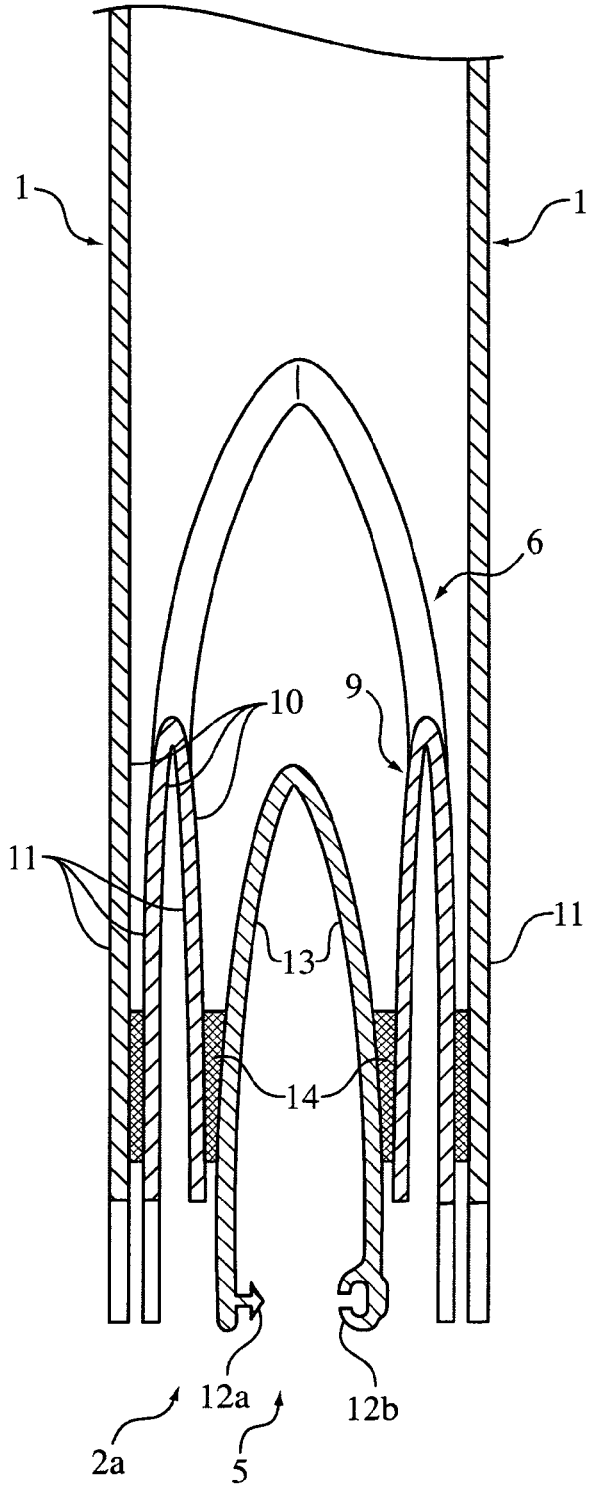
FIG. 3 shows a section along the line A-A in FIG. 2.

As is apparent from FIG. 1 and in particular from FIG. 3, the reclosure 5 running in the longitudinal direction is fastened with a first part on an inner surface 9 of the side gusset 2*a* and with a second part on an inner surface of the two front walls 1. As is indicated in FIG. 3, the film from which the side-gusseted bag is formed comprises a heat-sealable layer 10 of polyolefin, in particular polyethylene, forming the inner surface 9 and an outer layer 11 of polyethylene terephthalate.

The reclosure 5 comprises two profiles 12*a*, 12*b* which can be locked to one another and according to FIG. 3 respectively adjoining connecting flanges 13. The connecting flanges 13 are joined by longitudinal sealing seams 14 to the inner surface 8 of the folded-over section 6 and above this, to the inner surface of the front walls 1. In addition, the folded-over section 6 of the side gusset is fastened to the front walls 1 along the longitudinal sealing seam 14.

In order to ensure an authenticity seal, the connecting flanges 13 are detachably joined to one another for opening the side-gusseted bag for the first time. According to the embodiment described, it is further provided that a slider 15 overlaps the profiles 12*a*, 12*b*, wherein a movement of the slider 15 in a first direction effects a joining and a movement in a second direction effects a separation of the profiles 12*a*, 12*b*. In order to be able to actuate the slider 15, the profiles 12*a*, 12*b* must project laterally. For this reason, according to FIG. 2, the front walls 1 are set back in the region of the reclosure 5 in such a manner that the reclosure 5 projecting from the front walls 1 at the associated longitudinal side is approximately flush with the non-set-back part of the front walls 1.

The second side gusset 2*b* opposite the reclosure 5 can extend over the entire side-gusseted bag and end at the transverse sealing seams 16 at the base 3 and the top 4. As indicated in FIG. 2, the side-gusseted bag can optionally be provided with a carrying handle 17, 17'. It is thus possible to seal a larger region at the top 4 and provide a carrying handle 17 in the form of a grip opening in the sealed region by making an incision or a stamping. Alternatively, it can also be provided that a carrying handle 17' is arranged in the form of a film strip on one of the side gussets 2*a*, 2*b*.

FIGS. 4*a* to 4*g* show individual steps during a suitable manufacturing process to form the previously described side-gusseted bag. According to FIG. 4*a*, a bag blank 18 is initially formed from a continuous film web or individual film sections for the front walls 1 and the side gussets 2*a*, 2*b*. If this bag blank 18 is composed of individual film sections, these sections are not joined together at least in the top region. During the manufacture of the side-gusseted bag from a single film web, corresponding incisions should be made in the top region.

Figure 4A:
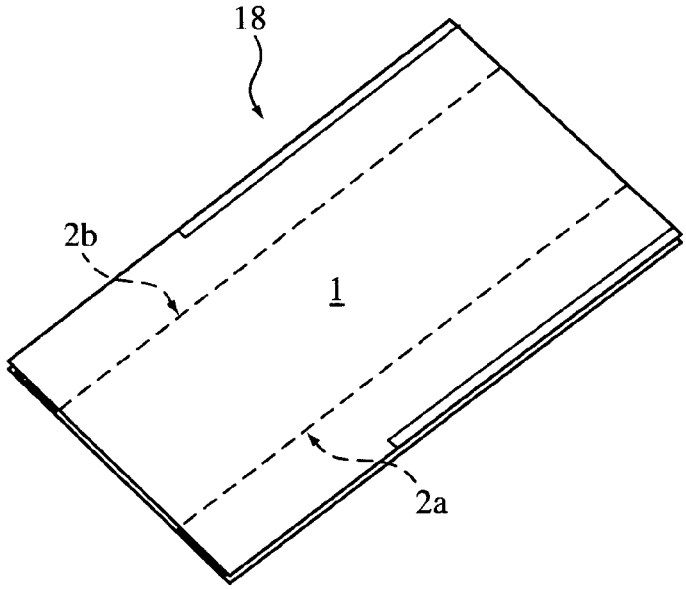
FIGS. 4*a* to 4*g* show individual steps during manufacture of the side-gusseted bag.
Figure 4B:
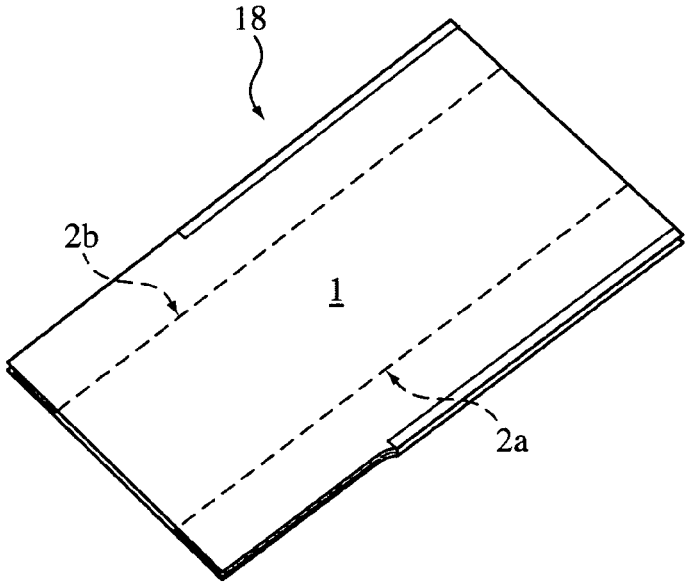

According to FIG. 4*b*, a lateral region of the front wall 1 is stamped out at that point where the reclosure 5 is to be arranged subsequently so that the reclosure 5 can easily be arranged in a set back manner.

Figure 4C:
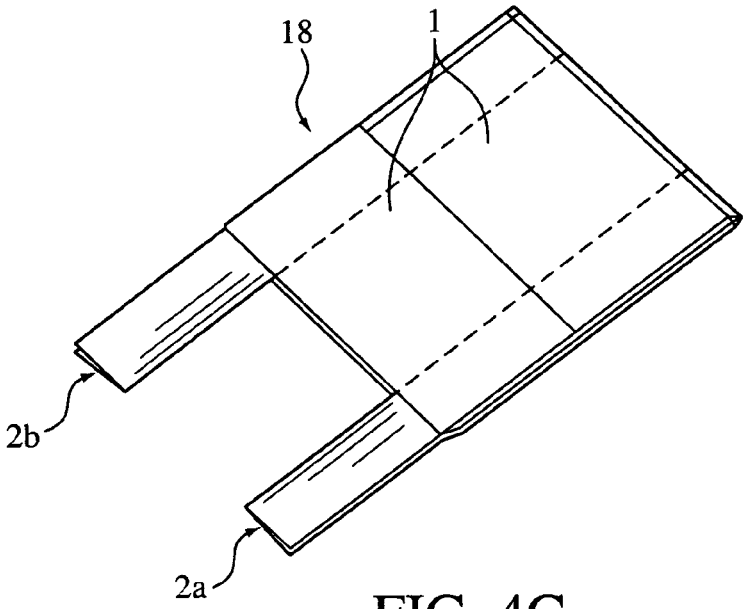

According to FIG. 4*c*, the front walls 1 of the bag blank 18 are folded back, thus exposing the upper regions of the side gussets 2*a*, 2*b*. The side gusset 2*a* to which the reclosure is subsequently fastened is cut to the desired size (FIG. 4*d*) and folded over outwards towards the longitudinal side of the bag along two fold lines 8 emanating from a central line 7. The sequence of cutting to size and folded over is not restricted within the context of the invention.

Figure 4D:
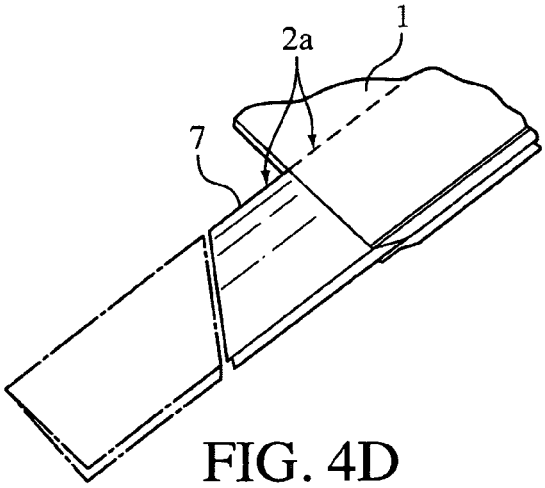
Figure 4E:
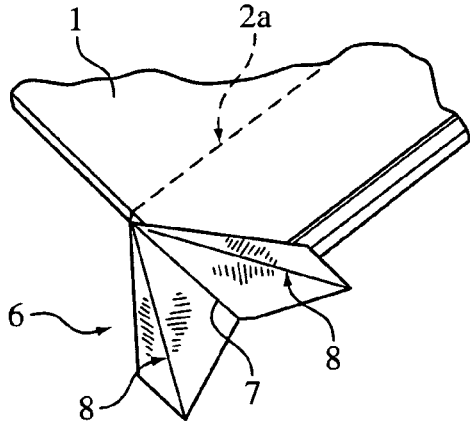
Figure 4F:
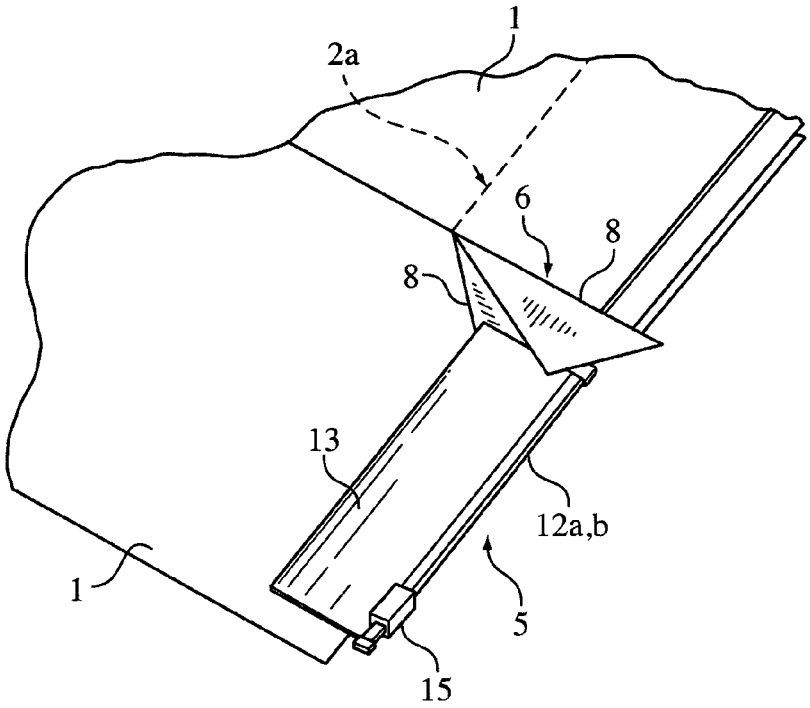
Figure 4G:
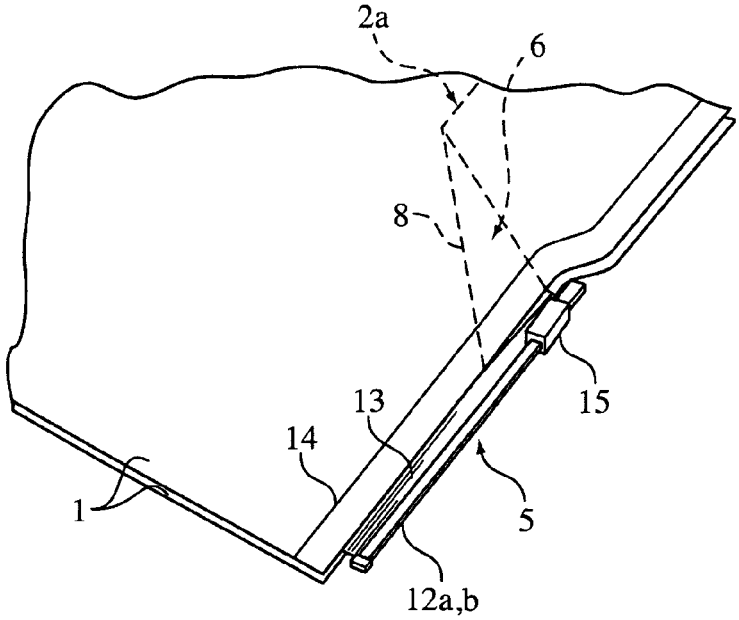

In order to arrange the reclosure 5, the folded-over section 6 of the side gusset 2*a* is folded up according to FIG. 4*f*, the reclosure 5 then being fastened to one of the front walls 1 and a part of the folded-over section 6, for which a pre-fixing is initially sufficient. After folding back the front walls 1, the reclosure 5 is finally sealed in an airtight manner by heat sealing.

A ready-prepared side-gusseted bag provided for subsequent filling is preferably provided according to the invention. The side-gusseted bag can be transported and stored in the laid-flat state before a filling material is introduced at the top and the side-gusseted bag is then closed. The arrangement of the reclosure 5 on the longitudinal side according to the invention also has the advantage that a filling funnel can easily be introduced and the side-gusseted bag can be opened wide for filling.

FIGS. 5*a* to 5*d* relate to a variant of the previously described method wherein a side-gusseted bag is formed in which the reclosure 5 configured as described previously, comprising interlockable profiles 12*a*, 12*b*, adjoining connecting flanges 13 and a slider 15, is arranged covered before opening for the first time. As explained in detail hereinafter, this is achieved by arranging the reclosure 5 in an inwardly offset manner wherein, however, the front walls 1 are not correspondingly cut out and thus overlap the reclosure 5.

Figure 5A:
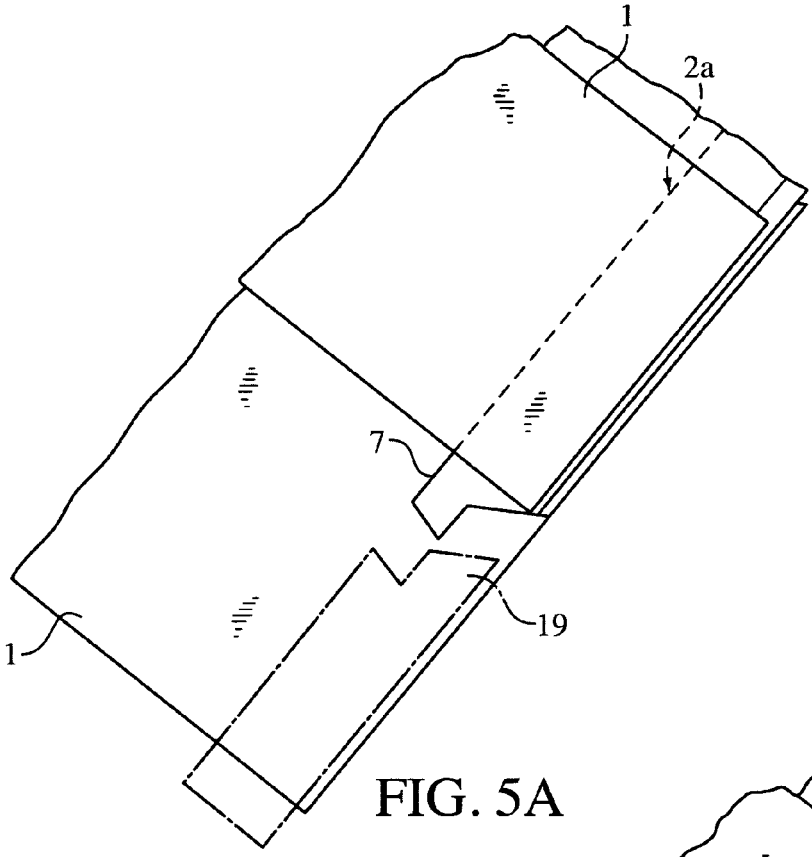
FIGS. 5*a* to 5*d* show a variant of the method shown in FIGS. 4*a* to 4*g*.
Figure 5B:
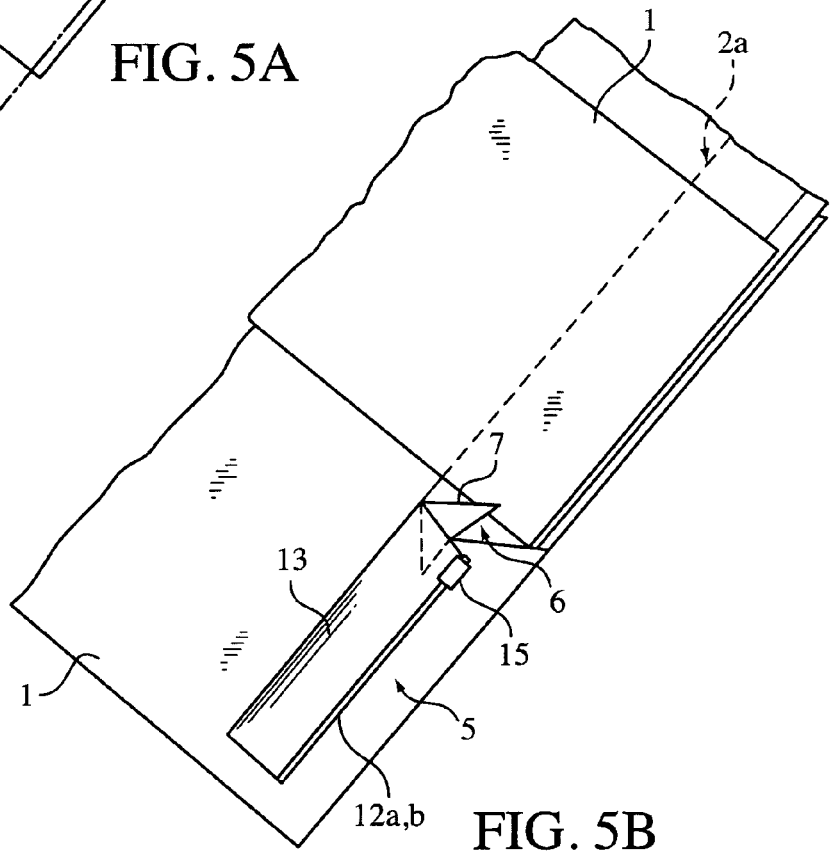

Starting from an initially consistent fabrication, unlike in FIG. 4*d*, the side gusset 2*a* is not shortened along a straight line. Rather, in addition to a sloping cut, starting from the central line 7, an outer edge 19 of the side gusset 2*a* is also removed. Accordingly, after folding over the upper end section 6, the reclosure 5 is then arranged inwardly offset with respect to the edge of the front walls 1. The central line 7 is folded over so that this is slightly rising at an angle between 15° and 20° with respect to the upper side of the bag. When cutting the side gusset 2*a*, the angle set starting from the central line 7 was also previously selected accordingly. As can be seen in FIG. 5*a*, the reclosure is cut at a corresponding slope at its one end.

Figure 5C:
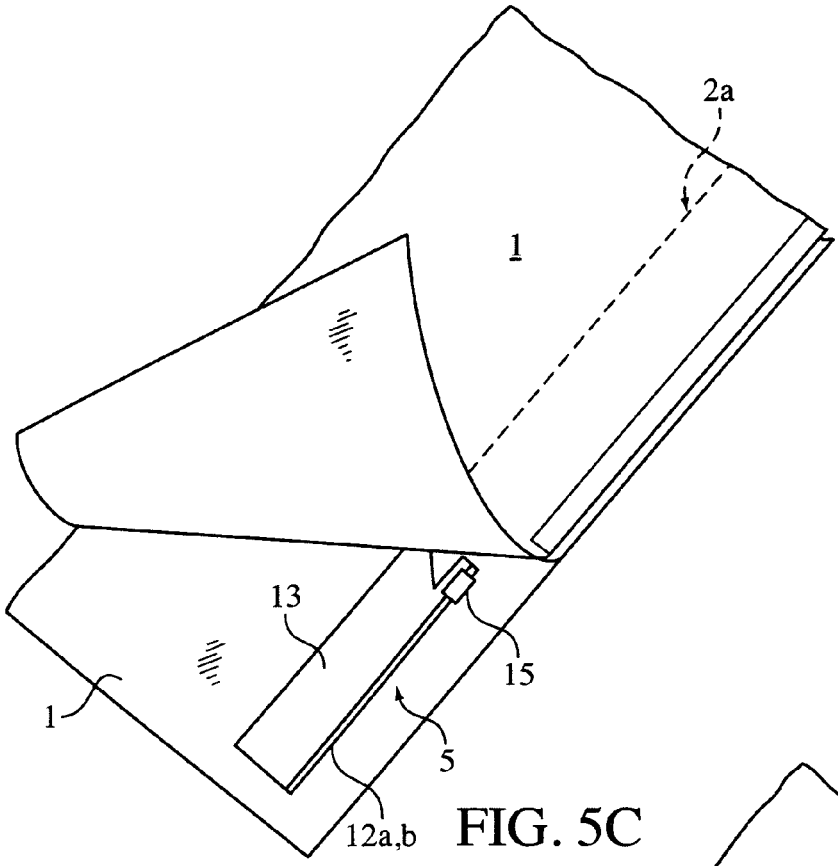

According to FIG. 5*c*, the reclosure 5 is covered when the previously folded-up sections of the front walls 1 are folded back again.

Figure 5D:
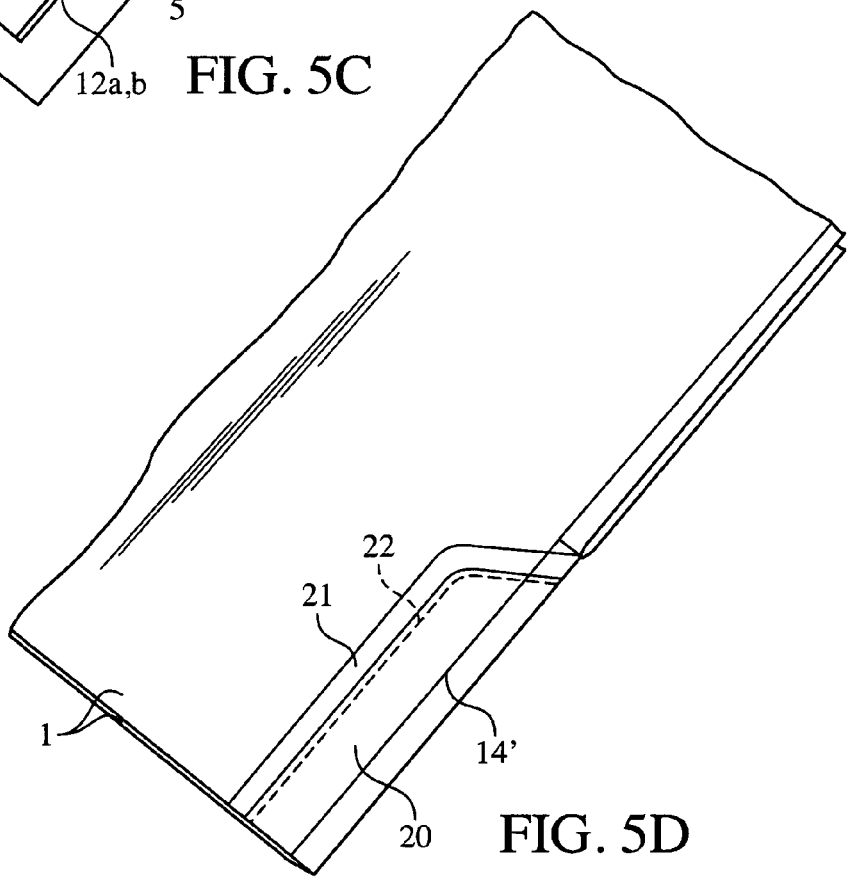

According to FIG. 5*d*, the wall sections 20 covering the reclosure 5 are joined to the reclosure 5 with a sealing seam 21, wherein at the side of the reclosure 5 along the longitudinal side an additional longitudinal sealing seam 14' is provided. A pocket is thus formed in which the reclosure 5 is protected. An accidental actuation of the slide 15 can thereby be eliminated. In order to be able to remove the wall section 20 forming the pocket and expose the reclosure 5 when opening for the first time, the front walls 1 are each provided with a previously produced weakening line 22, for example, in the form of a perforation.

Although only at least one embodiment of the present invention has been shown and described, it is to be understood that many changes and modifications may be made thereunto without departing from the spirit and scope of the invention as defined in the appended claims.

What is claimed is:

1. A side-gusseted bag having two front walls which are joined by a side gusset at a longitudinal side provided with a reclosure running in a longitudinal direction, wherein an end section of the side gusset is folded-over in the region of the reclosure in such a manner that a central line running in the longitudinal direction in a non-folded-over region of the side gusset is bent at an angle, wherein the reclosure is fastened to an inner surface of the side gusset at the folded-over end section, wherein the side gusset is folded over at two fold lines running obliquely outwards, and wherein said two fold lines and said reclosure extend at least partially along a common longitudinal section of the bag.

2. The side-gusseted bag according to claim 1, wherein the central line bends at an angle between 95° and 40° at a transition to the folded-over end section.

3. The side-gusseted bag according to claim 1, wherein the side gusset ends with its folded-over end section at a distance from an associated transverse side.

4. The side-gusseted bag according to claim 3, wherein the reclosure is fastened with a first part on the inner surface of the side gusset and with a second part on an inner surface of the two front walls.

5. The side-gusseted bag according to claim 3, wherein the reclosure extends as far as the associated transverse side.

6. The side-gusseted bag according to claim 1, wherein an outer edge of the side gusset is removed at the end section.

7. The side-gusseted bag according to claim 6, wherein the folded-over end section as well as the reclosure fastened thereon end at a distance from the associated longitudinal side and are covered by wall sections of the front walls.

8. The side-gusseted bag according to claim 7, wherein the wall sections covering the reclosure are interconnected at the associated longitudinal side.

9. The side-gusseted bag according to claim 8, wherein the wall sections covering the reclosure and connected to one another can be separated along a line of weakening to expose the reclosure.

10. The side-gusseted bag according to claim 1, wherein the front walls are set back in the region of the reclosure in such a manner that the reclosure projecting from the front walls at the associated longitudinal side is approximately flush with a non-set-back part of the front walls.

11. The side-gusseted bag according to claim 1, wherein the reclosure comprises two interlockable profiles, each adjoined by a connecting flange.

12. The side-gusseted bag according to claim 11, wherein the reclosure comprises a slider which overlaps the profiles, wherein a movement of the slider in a first direction effects a joining and in a second direction effects a separation of the profiles.

13. The side-gusseted bag according to claim 1, wherein the reclosure is fastened by heat sealing.

14. The side-gusseted bag according to claim 1, wherein a second side gusset is provided on the longitudinal side opposite the reclosure.

15. The side-gusseted bag according to claim 1, wherein a first transverse side forms a base and a second transverse side forms a top of the bag, wherein the base and the top are joined by the front walls and the at least one interposed side gusset (a, and wherein the reclosure is disposed directly below the top.

16. The side-gusseted bag according to claim 1, wherein the side gusset provided with the reclosure or an opposite side gusset has a carrying handle.

17. The side-gusseted bag according to claim 1, wherein the front walls and the at least one side gusset are formed by folding and heat sealing a bag film.

18. The side-gusseted bag according to claim 17, wherein the bag film is configured to be multilayer and comprises a layer of polyolefin forming the inner side of the front walls and the at least one side gusset and a layer forming the outer layer of the front walls and the at least one side gusset having a higher softening temperature.

19. A method for producing a side-gusseted bag, comprising the following steps:

producing two front walls and at least one interposed side gusset;

folding one end of the side gusset along two oblique fold lines emanating from a central line running in the a longitudinal direction of the side gusset;

arranging a reclosure running in the longitudinal direction on a folded-over end section of the side gusset; and fastening the reclosure on an inner surface of the side gusset in such a manner that said two fold lines and said reclosure extend at least partially along a common longitudinal section of the bag.

20. The method according to claim 19, wherein a bag blank having a top region is formed from the front walls and two interposed side gussets, in which the side gussets are not joined to the front walls in a top region and wherein the at least one front wall is folded back in the top region in such a manner that the ends of the side gussets are exposed.

21. The method according to claim 20, wherein after folding back the at least one front wall onto themselves, the reclosure is fastened on the folded-over end section of one of the side gussets.

22. The method according to claim 21, wherein the region of the at least one front wall folded onto itself is folded back after arranging the reclosure and joined to the side gussets.

23. The method according to claim 20, wherein the reclosure is joined to the inner surface of the side gussets and above the side gussets to the inner surfaces of the front walls.

24. The method according to claim 19, wherein the reclosure is fastened by heat sealing.

25. The method according to claim 19, wherein the side gusset on which the reclosure is arranged, is shortened and trimmed at its outer edge before folding over so that after folding over, the folded-over region and the reclosure fastened thereon are covered by wall sections of the front walls, wherein the wall sections are joined in such a manner that a pocket closed at the edge side is formed in which the reclosure is arranged in a protected manner.

* * * * *

UNITED STATES PATENT AND TRADEMARK OFFICE

CERTIFICATE OF CORRECTION

PATENT NO. : 8,430,566 B2
APPLICATION NO. : 12/799819
DATED : April 30, 2013
INVENTOR(S) : Brauer et al.

It is certified that error appears in the above-identified patent and that said Letters Patent is hereby corrected as shown below:

In the Claims

In Column 9, line 13 (line 5 of Claim 15) please delete: "(a".

In Column 9, line 32 (line 6 of Claim 19) please delete: "the".

In Column 10, line 10 (line 4 of Claim 20) after the word "wherein" please delete: "the".

In Column 10, line 20 (line 1 of Claim 23) please change "20" to correctly read: --19--.

Signed and Sealed this
Twenty-fourth Day of December, 2013

Margaret A. Focarino

Margaret A. Focarino
*Commissioner for Patents of the United States Patent and Trademark Office*